US008374922B1

(12) United States Patent
Antony

(10) Patent No.: US 8,374,922 B1
(45) Date of Patent: Feb. 12, 2013

(54) FULFILLMENT NETWORK WITH CUSTOMER-TRANSPARENT COSTS

(75) Inventor: Felix F. Antony, Issaquah, WA (US)

(73) Assignee: Amazon Technologies, Inc., Reno, NV (US)

( * ) Notice: Subject to any disclaimer, the term of this patent is extended or adjusted under 35 U.S.C. 154(b) by 1805 days.

(21) Appl. No.: 11/525,590

(22) Filed: Sep. 22, 2006

(51) Int. Cl.
*G06Q 30/00* (2006.01)

(52) U.S. Cl. ..... 705/26.81; 705/27.1; 705/28; 705/26.1

(58) Field of Classification Search ..... 705/26, 705/27, 28
See application file for complete search history.

(56) References Cited

U.S. PATENT DOCUMENTS

| | | | | |
|---|---|---|---|---|
| 5,631,827 | A | 5/1997 | Nicholls et al. | |
| 5,715,314 | A | 2/1998 | Payne et al. | |
| 5,897,629 | A | 4/1999 | Shinagawa et al. | |
| 5,909,492 | A | 6/1999 | Payne et al. | |
| 5,960,411 | A | 9/1999 | Hartman et al. | |
| 6,029,141 | A | 2/2000 | Bezos et al. | |
| 6,101,482 | A | 8/2000 | DiAngelo et al. | |
| 6,223,215 | B1 | 4/2001 | Hunt et al. | |
| 6,324,522 | B2 * | 11/2001 | Peterson et al. | 705/28 |
| 6,405,176 | B1 | 6/2002 | Toohey | |
| 6,415,195 | B1 | 7/2002 | Gleditsch et al. | |
| 6,415,196 | B1 | 7/2002 | Crampton et al. | |
| 6,449,599 | B1 | 9/2002 | Payne et al. | |
| 6,587,827 | B1 | 7/2003 | Hennig et al. | |
| 6,622,127 | B1 | 9/2003 | Klots et al. | |
| 6,725,222 | B1 | 4/2004 | Musgrove et al. | |
| 6,845,364 | B1 | 1/2005 | Pool et al. | |
| 6,873,968 | B2 | 3/2005 | Ehrlich et al. | |
| 7,050,938 | B1 | 5/2006 | Prater et al. | |
| 7,058,587 | B1 | 6/2006 | Horne | |
| 7,117,170 | B1 | 10/2006 | Bennett et al. | |
| 7,184,973 | B2 | 2/2007 | Monteleone et al. | |
| 7,197,478 | B2 | 3/2007 | Kargman | |
| 7,222,087 | B1 | 5/2007 | Bezos et al. | |
| 7,295,990 | B1 * | 11/2007 | Braumoeller et al. | 705/7 |

(Continued)

FOREIGN PATENT DOCUMENTS

| | | |
|---|---|---|
| WO | 0068859 | 11/2000 |
| WO | 0108071 | 2/2001 |

OTHER PUBLICATIONS

"SAS/OR software," 7 pages, from www.archive.com, 1998.

(Continued)

*Primary Examiner* — Robert M. Pond
(74) *Attorney, Agent, or Firm* — Robert C. Kowert; Meyertons, Hood, Kivlin, Kowert & Goetzel, P.C.

(57) ABSTRACT

Methods and systems for customer-transparent inventory fulfillment costs. A method may include an enterprise detecting a customer's selection of a given one of a number of inventory items, and in response to detecting the selection, the enterprise generating a display and instructing that the display be displayed to the customer. The display may include fulfillment options for the given item, where each of the options includes an indication of a corresponding fulfillment entity within a fulfillment network and an indication of a corresponding price. The price may be determined dependent upon fulfillment costs of completing order fulfillment of the given item for the customer from the corresponding fulfillment entity. The method may further include the enterprise detecting placement by the customer of an order specifying the given inventory item and a particular fulfillment option, and the enterprise conveying fulfillment instructions to the fulfillment entity corresponding to the particular fulfillment option.

35 Claims, 8 Drawing Sheets

U.S. PATENT DOCUMENTS

| | | | | |
|---|---|---|---|---|
| 7,370,009 | B1 | 5/2008 | Notani et al. | |
| 7,406,472 | B2 | 7/2008 | Manucha et al. | |
| 7,747,543 | B1 | 6/2010 | Braumoeller et al. | |
| 2002/0016759 | A1 | 2/2002 | Macready et al. | |
| 2002/0022978 | A1* | 2/2002 | Schiff et al. | 705/5 |
| 2002/0026347 | A1 | 2/2002 | Yanagino et al. | |
| 2002/0055893 | A1* | 5/2002 | Mizumachi et al. | 705/29 |
| 2002/0082954 | A1 | 7/2002 | Dunston | |
| 2002/0095307 | A1 | 7/2002 | Greamo et al. | |
| 2002/0133387 | A1 | 9/2002 | Wilson et al. | |
| 2002/0138496 | A1 | 9/2002 | Schambach et al. | |
| 2002/0156663 | A1 | 10/2002 | Weber et al. | |
| 2002/0169657 | A1 | 11/2002 | Singh et al. | |
| 2002/0178074 | A1 | 11/2002 | Bloom | |
| 2002/0188499 | A1 | 12/2002 | Jenkins et al. | |
| 2003/0033180 | A1 | 2/2003 | Shekar et al. | |
| 2003/0033205 | A1 | 2/2003 | Nowers et al. | |
| 2003/0069831 | A1 | 4/2003 | Le et al. | |
| 2003/0083949 | A1 | 5/2003 | Kar | |
| 2003/0093388 | A1* | 5/2003 | Albright | 705/400 |
| 2003/0115072 | A1 | 6/2003 | Manucha et al. | |
| 2003/0171962 | A1 | 9/2003 | Hirth et al. | |
| 2003/0172007 | A1 | 9/2003 | Helmolt et al. | |
| 2003/0217018 | A1 | 11/2003 | Groff et al. | |
| 2004/0064351 | A1 | 4/2004 | Mikurak | |
| 2004/0111286 | A1 | 6/2004 | Koenig et al. | |
| 2004/0117337 | A1 | 6/2004 | Beck et al. | |
| 2004/0254842 | A1 | 12/2004 | Kirkegaard | |
| 2005/0006456 | A1 | 1/2005 | White | |
| 2005/0033671 | A1 | 2/2005 | Hahn-Carlson | |
| 2005/0081151 | A1 | 4/2005 | Van Der Meer | |
| 2005/0114222 | A1 | 5/2005 | Mundy | |
| 2005/0125312 | A1 | 6/2005 | Dearing et al. | |
| 2005/0149377 | A1 | 7/2005 | Schierholt | |
| 2005/0154904 | A1 | 7/2005 | Perepa et al. | |
| 2005/0197892 | A1 | 9/2005 | Bilibin et al. | |
| 2006/0036504 | A1 | 2/2006 | Allocca et al. | |
| 2006/0059062 | A1* | 3/2006 | Wood et al. | 705/35 |
| 2006/0089897 | A1 | 4/2006 | Maas et al. | |
| 2006/0116936 | A1 | 6/2006 | Lucas | |
| 2006/0122892 | A1 | 6/2006 | Fletcher et al. | |
| 2006/0122897 | A1 | 6/2006 | Fletcher et al. | |
| 2006/0190362 | A1 | 8/2006 | Krystek et al. | |
| 2006/0195364 | A1 | 8/2006 | Shroff et al. | |
| 2007/0073551 | A1 | 3/2007 | Williams et al. | |
| 2007/0073552 | A1 | 3/2007 | Hileman | |
| 2007/0078725 | A1 | 4/2007 | Koszewski et al. | |
| 2007/0094510 | A1 | 4/2007 | Ross et al. | |
| 2007/0143206 | A1 | 6/2007 | Cui et al. | |
| 2007/0226052 | A1 | 9/2007 | Abbott | |

OTHER PUBLICATIONS

"SAS OnlineDoc" version 8, 29 pages, www.v8doc.sas.com, 1999.

"Supply Chain Optimization: A methodology for strategic and tactical planning," by Cohen, et al., SAS Institute white paper, Jan. 1999, 14 pages.

"Distributed supply chain simulation across enterprise boundaries," by Ping, et al., SIMTech Technical Report (MIT/00/017/MAPS), 2000, 9 pages.

"Technology for supporting supply chain management: introduction," by Kumar, Communications of the ACM, Jun. 2001, 4 pages.

"How i2 integrates simulation in supply chain optimization," by Padmos, et al., Proceedings of the 1999 Winter Simulation Conference, 1999, 6 pages.

"Supply chain design and analysis: models and methods" by Beamon, International Journal of Production Economics, 1998, 22 pages.

"A Dynamic model for requirements planning with application to supply chain optimization," by Graves, et al., Operations Research, May-Jun. 1998, 45 pages.

"Decision making Through Operations Research," by Thierauf, et al., John Wiley 7 Sons Publishing, 1975, 70 pages.

"Simulation modeling and optimization using Promodel" by Heflin, et al., Proceedings of the 1998 Winter Simulation Conference, 1998, 7 pages.

"Simulation Modeling and optimization using Promodel" by Benson, Proceedings of the 1997 Winter Simulation Conference, 1997, 7 pages.

Promodel Resource Central, 2 pages from webarchive.com, 1998.

"Combined Discrete-continuous simulation models in Promodel for Windows," by Klingener, Proceedings of the 1995 Winter Simulation Conference, 1995, 9 pages.

"Using Simulation Optimization to find the best solution" by Akbay, IIE Solutions, May 1996, 6 pages.

"Linear Programming applied to a production blending problem: a spreadsheet modeling approach" by Shammari, et al., Production and inventory Management Journal, first Quarter 1997, 5 pages.

"Introduction to ProcessModel and ProcessModel 9000" by Gladwin, et al., Proceedings of the 1997 Winter Simulation Conference, 1997, 7 pages.

"Using Simulation to Schedule Manufacturing Resources," by Czarnecki, et al. Proceedings of the 1997 Winter Simulation Conference, 1997, 8 pages.

"Cost Accounting" by Horngren, et al., Prentice Hall Publishers, 2000, 37 pages.

"Simulation Optimization Using Soft Computing" by Medaglia, Dissertation for Doctor of Philosophy at North Carolin0 State University, 2001, 144 pages.

"Decision support with web-enabled software," by Cohen, et al., Interfaces, Mar.-Apr. 2001, 14 pages.

Amazon.com, Inc. Form 10-K/A for Fiscal Year 1999, 40 pages.

U.S. Appl. No. 11/958,852, filed Dec. 18, 2007.

U.S. Appl. No. 11/958,852, filed Feb. 26, 2008.

U.S. Appl. No. 11/756,160, filed May 31, 2007.

U.S. Appl. No. 11/751,433, filed May 21, 2007.

U.S. Appl. No. 11/852,040, filed Sep. 7, 2007.

Cohen, "Electronic Commerce," Information Sciences Institute Research Report ISI/RR-89-244, Oct. 1989, 46 pages.

Amazon Advantage Membership Agreement, Instructions & Rules, Dec. 6, 2004, downloaded from web.archive.org/web/20041211005149/www.amazon.com/exec/obidos/subst/partners/direct/direct-agreement.html, 9 pages.

Amazon Advantage Overview, downloaded from web.archive.org/web/20041024162213/www.amazon.com/exec/obidos/subst/partners/direct/advantage/home.html/, 2 pages.

Amazon.com Press Release, "Target and Amazon.com team to advanced e-commerce initiatives," Sep. 11, 2001, 2 pages.

Amazon.com Press Release, "Target to deliver four unique brands in one comprehensive site at target.com," Aug. 12, 2002, 2 pages.

U.S. Appl. No. 11/351,881, filed Feb. 10, 2006.

* cited by examiner

You have selected Item A. Please choose from among the following fulfillment options:

| | Price: | Fulfiller: | Ships within: |
|---|---|---|---|
| Select | $5.99 | Enterprise FC - San Francisco | 24 hours |
| Select | $6.50 | Enterprise FC - Chicago | 3-4 days |
| Select | $7.75 | Enterprise FC - Boston | 1-2 days |

Fulfillment options 510

Display 500

FIG. 5A

You have selected Item A. Please choose from among the following fulfillment options:

| | | Price: | Fulfiller: | Ships within: |
|---|---|---|---|---|
| Select | Item price: | $5.00 | Enterprise FC - San Francisco | 24 hours |
| | Fulfillment cost: | $0.99 | | |
| | Total: | $5.99 | | |
| Select | Item price: | $5.00 | Enterprise FC - Chicago | 3-4 days |
| | Fulfillment cost: | $1.50 | | |
| | Total: | $6.50 | | |
| Select | Item price: | $5.00 | Enterprise FC - Boston | 1-2 days |
| | Fulfillment cost: | $2.75 | | |
| | Total: | $7.75 | | |

Fulfillment options 510

Display 500

FIG. 5B

You have selected multiple items for your order. Please choose how your items should be grouped for order fulfillment:

| | | Price: | Fulfiller: | Ships within: |
|---|---|---|---|---|
| Select Group 1 | Item A price: | $5.99 | Enterprise FC - Midwest | 2-3 days |
| | Item B price: | $7.99 | Enterprise FC - Midwest | 2-3 days |
| | Total: | $13.98 | | |
| Select Group 2 | Item A price: | $6.75 | Enterprise FC - West Coast | 24 hours |
| | Item B price: | $9.50 | Enterprise FC - Midwest | 2-3 days |
| | Total: | $16.25 | | |

Select a different grouping

Display 500

*FIG. 5C*

FULFILLMENT NETWORK WITH CUSTOMER-TRANSPARENT COSTS

BACKGROUND OF THE INVENTION

1. Field of the Invention

This invention relates to materials handling systems and, more particularly, to management of costs within a materials handling system.

2. Description of the Related Art

An enterprise that receives, consumes, transforms or distributes material during the course of its operations may implement a materials handling system to coordinate how material is managed within the enterprise. For example, in a manufacturing context, material may include raw materials, feedstocks, parts, etc. that may arrive at a manufacturing facility for processing as well as intermediate or finished goods resulting from the manufacturing process. Similarly, in a distribution context, retailers, wholesalers and other types of distributors may receive materials such as goods or products and distribute them to clients or customers.

Material may be stored as inventory within an inventory facility and made available for ordering or use by clients or customers. For example, in a manufacturing context, a client may include a step of a manufacturing process that includes a particular type of material as an input, while in a retail context, a client may include a customer who places an order for a product. In conventional materials handling systems, like items often may be stored together within inventory. For example, items having a common Universal Product Code (UPC), Stock-Keeping Unit (SKU) code, or other designation (including proprietary designations) may be stored together within inventory.

When retrieval of material from inventory is necessary, for example in response to a client's order or to replenish a manufacturing process, one or several inventory items must be retrieved or "picked" from inventory and prepared for delivery to the requestor or recipient. In an inventory environment that includes a large number of many different items and services the demands of a number of different requesters, at any given time there may be a substantial number of outstanding requests for picking items. To improve picking productivity, a materials handling system may employ multiple item pickers distributed throughout an inventory facility and may assign different picking operations (including, in some cases, picking of different items for a single order) to different pickers.

The costs of providing material from inventory to a customer may be affected by the availability of ordered material within the materials handling facility. For example, if a customer orders several items that are not available within a single facility, the costs for separately providing the items to the customer may be considerably higher than if the items were located within the same facility and could, for example, be picked, packaged and shipped together. Such excess costs due to inventory placement are typically borne by the enterprise and may erode profitability, for example with respect to low-margin inventory.

SUMMARY

Various embodiments of a method and system for managing customer orders using customer-transparent fulfillment costs are disclosed. In one embodiment, rather than absorbing the costs of fulfilling orders that are split across different fulfillment entities, an order management system may be configured to present a number of fulfillment options for a given inventory item to a customer. The options may reflect the fulfillment costs associated with fulfilling the given inventory item from various available fulfillment entities. The customer may then select how the order should be fulfilled. For example, the customer may select options that result in items being fulfilled from the same entity or different entities, and may pay fulfillment costs that vary correspondingly.

In one particular embodiment, a method may include an enterprise detecting a selection by a customer of a given one of a number of inventory items, and in response to detecting the selection, the enterprise generating a display and instructing that the display be displayed to the customer. The display may include fulfillment options for the given inventory item, where each of the fulfillment options includes an indication of a corresponding fulfillment entity within a fulfillment network and an indication of a corresponding price. The price may be determined dependent upon fulfillment costs of completing order fulfillment of the given inventory item for the customer from the corresponding fulfillment entity. The method may further include the enterprise detecting placement by the customer of an order specifying the given inventory item and a particular one of the plurality of fulfillment options, and the enterprise conveying fulfillment instructions to the fulfillment entity corresponding to the particular fulfillment option.

BRIEF DESCRIPTION OF THE DRAWINGS

FIGS. 5A-C are block diagrams illustrating embodiments of a display of fulfillment options.

Figure 1:
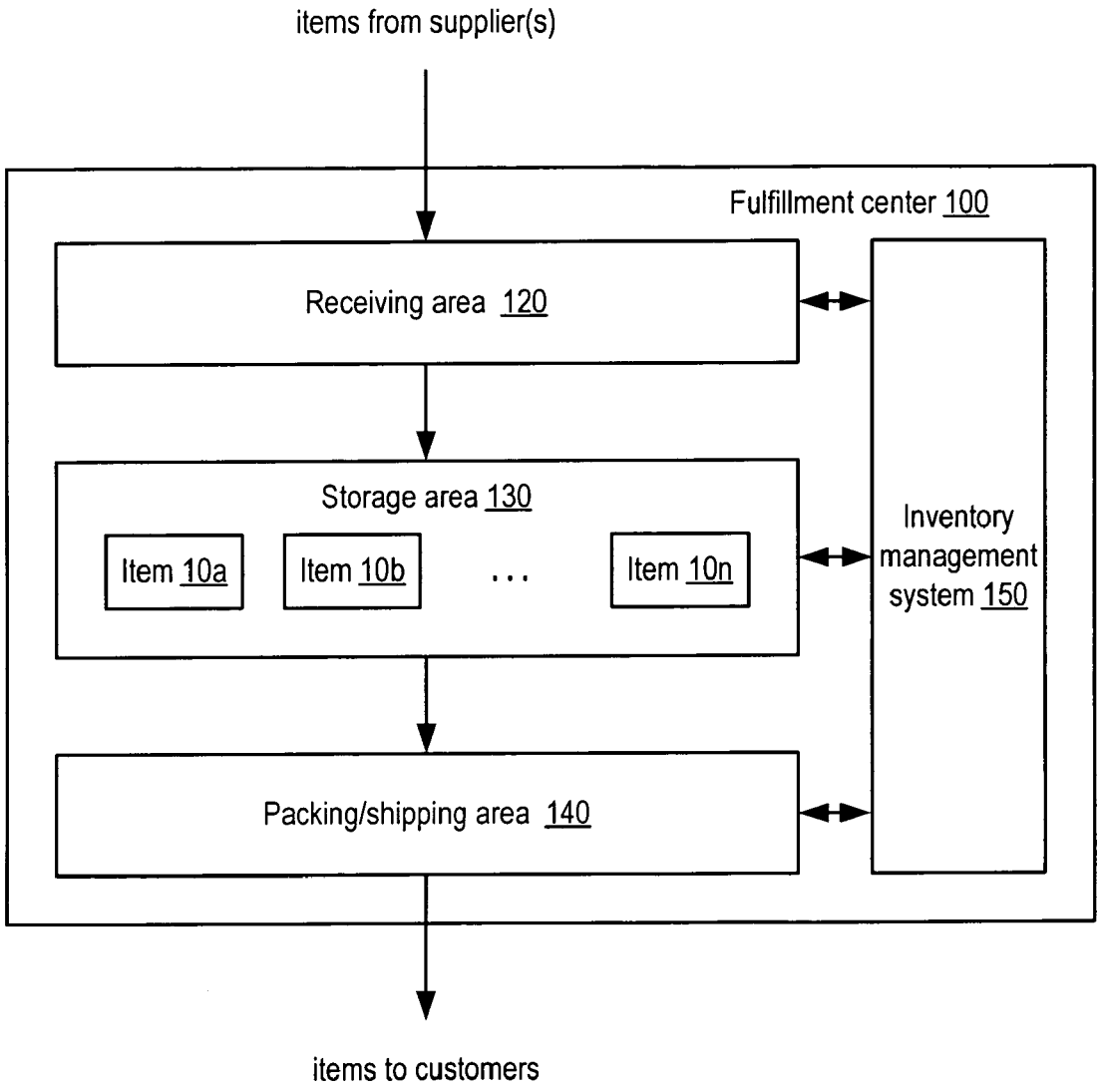
FIG. 1 is a block diagram illustrating one embodiment of a fulfillment center.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF EMBODIMENTS

Introduction

As summarized above, in some embodiments fulfillment options reflecting varying fulfillment costs for items may be presented to customers for selection during an ordering process. Various embodiments of methods and systems for order management using transparent fulfillment costs are described in detail below. Owing to the complexity of the disclosed techniques, discussion is divided into several sections to facilitate exposition. However, it is noted that embodiments of the methods and systems are not limited by the section headings or the particular order in which aspects of the system are described. Further, it is noted that in the following discussion, materials handling is described in the context of fulfillment of customer orders from a fulfillment center configured to store inventory items. However, it is intended that the terms "order fulfillment" and "fulfillment center" encompass any type of materials handling system in which material is stored and selected in response to a request or order.

First, an overview of an exemplary fulfillment center embodiment and examples of fulfillment networks including multiple fulfillment entities are provided. The problem of order assignment within a fulfillment network is discussed, and a method of generating a display of fulfillment options from which a customer may select is described. Several embodiments of such a display are discussed, and finally, an exemplary computer system embodiment that may be configured to implement the foregoing methods and techniques is described.

Fulfillment Center and Fulfillment Network Overview

As mentioned above, an enterprise such as a retailer, wholesaler, distributor, manufacturer or other type of entity may receive and store various types of inventory items, and may distribute selected inventory items to customers in response to customer orders. To facilitate inventory operations, such an enterprise may maintain one or more fulfillment centers. In more complex embodiments, an enterprise may maintain a fulfillment network that may include a number of enterprise-managed fulfillment centers and possibly contract or third-party inventory sources. The general organization of an exemplary fulfillment center is first described, followed by a discussion of embodiments of a fulfillment network.

An inventory facility or materials handling facility in which inventory selection for order fulfillment occurs may also be referred to as a fulfillment center. One embodiment of a fulfillment center configured to store inventory items is illustrated in FIG. 1. In the illustrated embodiment, fulfillment center 100 includes a receiving area 120, a storage area 130 configured to store an arbitrary number of items 10*a-n*, and a packing/shipping area 140. The arrangement of the various areas within the illustrated embodiment of fulfillment center 10 is depicted functionally rather than schematically. For example, in some embodiments, it is noted that multiple different receiving areas 120, storage areas 130 and packing/shipping areas 140 may be interspersed rather than segregated. Additionally, fulfillment center 100 includes an inventory management system 150 configured to interact with each of receiving area 120, storage area 130 and packing/shipping area 140. For example, as described below, system 150 may be configured to interact with other systems or agents located within the aforementioned areas.

Fulfillment center 100 may be configured to receive different kinds of items 10 from various suppliers and to store them until a customer order specifying particular ones of items 10 is received. The particular items 10 may then be selected from storage and sent to the customer. The general flow of items through fulfillment center 100 is indicated using arrows. Specifically, in the illustrated embodiment, items 10 may be received from one or more suppliers, such as manufacturers, distributors, wholesalers, etc. at receiving area 120. In various embodiments, items 10 may include merchandise, commodities, perishables, or any suitable type of item depending on the nature of the enterprise that operates fulfillment center 10. Upon being received from a supplier at receiving area 120, items 10 may be prepared for storage. For example, in some embodiments items 10 may be unpacked or otherwise rearranged, and inventory management system 150 (which, as described below, may include one or more software applications executing on a computer system) may be updated to reflect the type, quantity, condition, cost or any other suitable parameters with respect to newly received items 10.

It is noted that items 10 may be stocked, managed or dispensed in terms of countable, individual units or multiples of units, such as packages, cartons, crates, pallets or other suitable aggregations. Alternatively, some items 10 such as bulk products, commodities, etc. may be stored in continuous or arbitrarily divisible amounts that may not be inherently organized into countable units. Such items 10 may be managed in terms of measurable quantities such as units of length, area, volume, weight, time duration or other dimensional properties characterized by units of measurement. Generally speaking, a quantity of an item 10 may refer to either a countable number of individual or aggregate units of an item 10 or a measurable amount of an item 10, as appropriate.

After arriving through receiving area 120, items 10 may be stored within storage area 130. Storage area 130 may generally include any suitable configuration of racks, bins, shelves, open areas and/or other facilities for holding items 10 after they have been received and prior to their being picked or otherwise removed from inventory. As described in greater detail below in conjunction with the descriptions of FIGS. 2-3, in some embodiments, the placement of various types of items 10 within storage area 130 may vary depending on patterns of anticipated demand for the items 10. For example, the distribution of a given item 10 within storage area 130 may depend at least in part on a rate or volume with which the given item 10 is expected to be picked, or on a similar metric such as an average expected holding time for the given item 10.

When a customer order specifying one or more of items 10 is received, the corresponding items 10 may be selected or "picked" from storage area 130. In various embodiments, item picking may range from minimally automated to completely automated picking, including any suitable combination of manual and automated processes. For example, in one embodiment fulfillment center employees may pick items 10 using written or electronic pick lists derived from customer orders, while in another embodiment conveyor belts and robotics may be used to pick and transfer items 10. After the items 10 corresponding to a particular order are picked, they may be processed at packing/shipping area 140 for delivery to the customer. For example, items may be packaged for shipment to the customer using a common carrier, or simply bagged or otherwise prepared for direct transfer to a customer, e.g., at an order pickup counter. In some embodiments, further interaction with inventory management system 150 may occur when items 10 are picked from storage area 130 and/or processed at packing/shipping area 140, for example to update inventory records to reflect the removal of inventory, to record revenue for the sale or other transaction (e.g., lease, rental, exchange, etc.) and so forth.

It is noted that items 10 may be picked or selected from storage area 130 for reasons other than customer orders. For example, items 10 may be removed on account of damage, to be liquidated or otherwise disposed of, to be returned to a supplier, to be conveyed to a different fulfillment center 100, or for any other reason. In some embodiments, items 10 being picked for customer orders and for other reasons may be commingled in a manner transparent to the agent performing the picking, and subsequently sorted according to their intended destinations. It is further noted that a customer for a given order may be any entity that may place or request an order for one or more items, or have such an order placed or requested on its behalf. For example, a customer may be an individual or an organization. A customer may also be a virtual entity having a material input of some kind. For example, a customer may be a particular step or stage of a manufacturing, assembly or other type of process.

In some instances, a single fulfillment center 100 may be insufficient to meet an enterprise's operational demands. For example, an enterprise that seeks to serve customers in a large geographical area may wish to distribute inventory among multiple different fulfillment centers 100 in order to reduce shipping costs and/or times to customers. For certain types of items 10, such as items having special handling requirements that may be difficult to accommodate (e.g., bulky, perishable or exotic items), an enterprise may wish to make such items 10 available to customers for ordering while contracting fulfillment of such items 10 to a third party, rather than incurring the expense and/or complexity of attempting to manage such items 10 itself. A variety of other reasons may motivate implementation of a fulfillment network that offers different possible sources from which items 10 may be fulfilled.

Figure 2A:
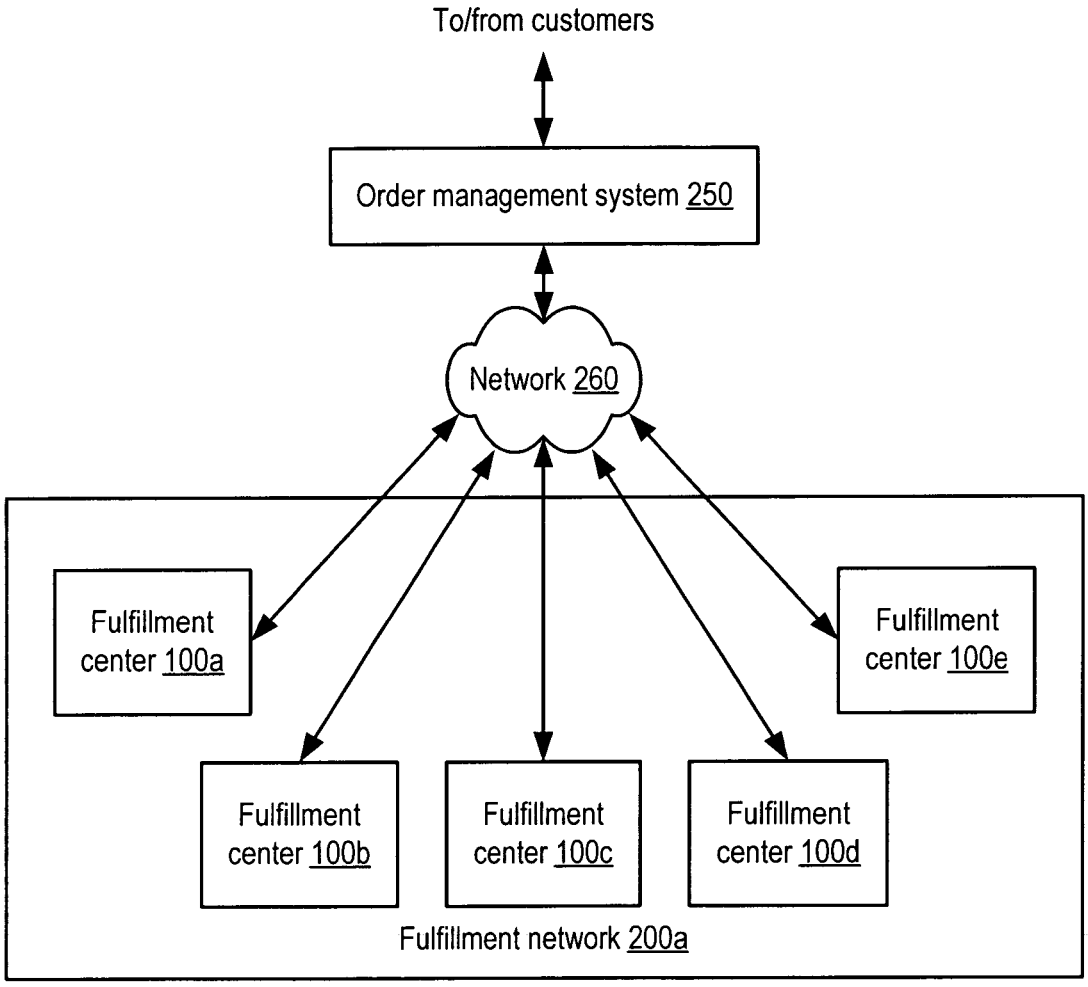
FIGS. 2A-B are block diagrams illustrating embodiments of a fulfillment network including multiple fulfillment entities.
Figure 2B:
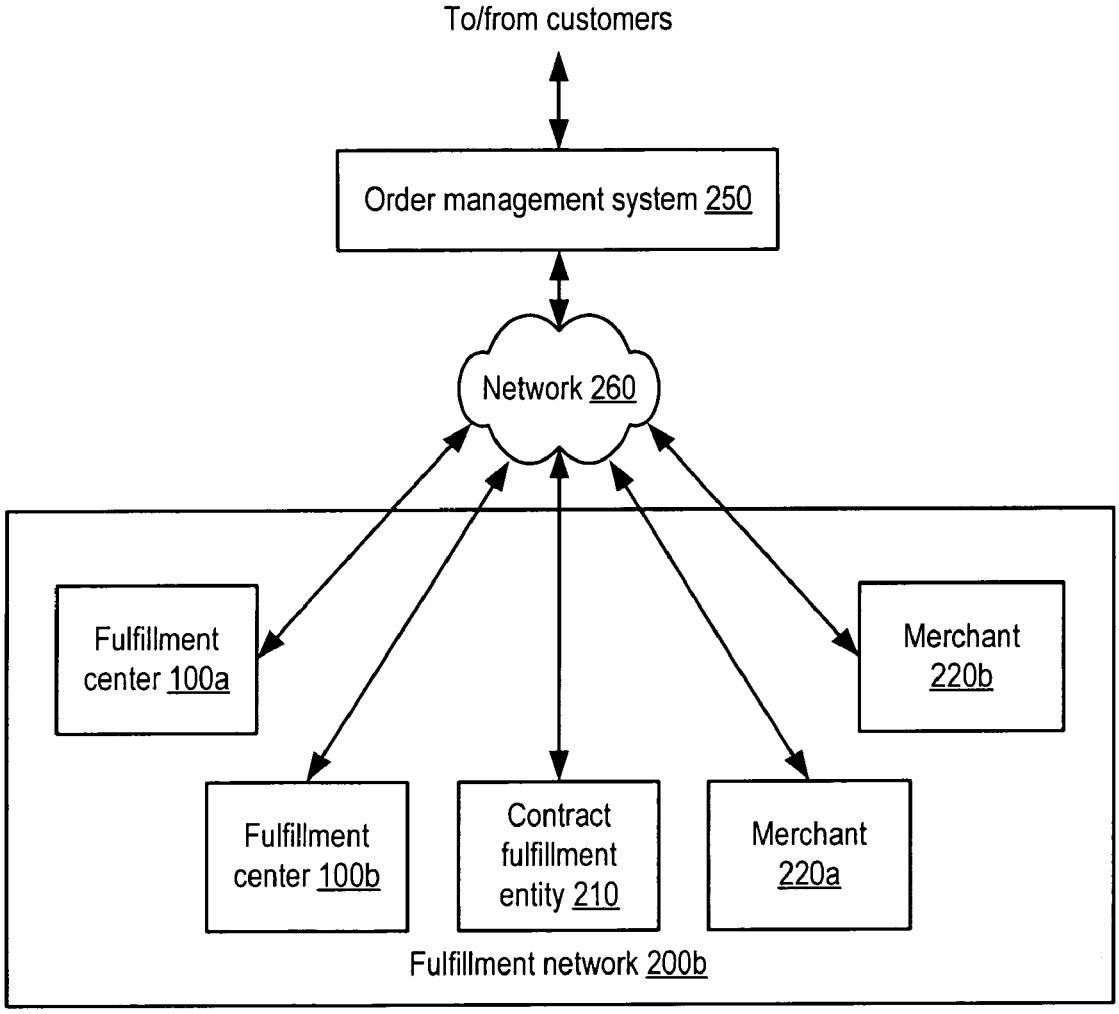

Generally speaking, a fulfillment network may include a number of different fulfillment entities, each capable of providing certain items 10 in response to customer orders. Several embodiments of a fulfillment network are illustrated in FIGS. 2A-B. In the embodiment of FIG. 200A, fulfillment network 200*a* includes a number of fulfillment centers 100*a-e*, each of which may be illustrative of fulfillment center 100 of FIG. 1. Fulfillment network 200*a* may be considered an example of a homogeneous fulfillment network, in which the enterprise establishing the network may maintain direct control over the management and contents of the fulfillment centers 100 within network 200*a*. For example, the enterprise may bear accounting or other financial responsibility for the items 10 stored within fulfillment centers 100, may directly determine how inventory and orders are managed and processed within fulfillment centers 100, and may act as the merchant of record for customer orders fulfilled from network 200*a*.

Another embodiment of a fulfillment network is illustrated in FIG. 2B. As shown, fulfillment network 200*b* includes a number of fulfillment centers 100*a-b*, as well as a contract fulfillment entity 210 and several merchants 220*a-b*. The various entities included within fulfillment networks 200*a-b* may be referred to generically as fulfillment entities, while fulfillment networks 200*a-b* may be referred to generically as fulfillment network 200.

Fulfillment network 200*b* may be considered an example of a heterogeneous fulfillment network, in which the enterprise establishing the network may in some instances delegate some degree of control of and/or financial responsibility for certain inventory items 10 to a fulfillment entity other than an enterprise-managed fulfillment center 100. For example, in the illustrated embodiment, contract fulfillment entity 210 may correspond to a drop shipper, franchised fulfiller or other third-party entity that has arranged to provide fulfillment services for certain items 10 on behalf of the enterprise that manages and supplies orders to fulfillment network 200. In some embodiments, contract fulfillment entity 210 may bear responsibility for its own costs in acquiring, storing, picking, packaging and shipping the inventory items 10 it fulfills on behalf of an enterprise in exchange for a fee or other compensation for fulfillment services, though in some such embodiments, the enterprise may still act as the merchant of record with regard to customer transactions fulfilled by contract fulfillment entity 210. In other embodiments, different financial and business relationships may be established between contract fulfillment entity 210 and the enterprise on behalf of which it acts. The cost burden of providing inventory holding and fulfillment services may be divided among the parties according to any suitable arrangement, for example on a per-item basis, on an aggregate basis over time, on the basis of actual utilization of services or a negotiated level of utilization, or other arrangements.

Merchants 220*a-b* may correspond to third-party entities which, like contract fulfillment entity 210, may provide their own fulfillment services for certain items 10. For example, merchants 220*a-b* may correspond to independent businesses that may arrange for an enterprise to provide a storefront or other business presence (e.g., via an electronic or web-based storefront or catalog), customer order management services, payment services and/or other types of business services. In response to receiving an order to be fulfilled, a merchant 220 may pick and ship a corresponding item 10 to a customer in any suitable fashion. In some embodiments, unlike contract fulfillment entity 210, merchants 220*a-b* may also serve as independent merchants of record for the customer orders they fulfill. That is, merchants 220*a-b* may assume the legal and financial responsibility for the customer transactions they fulfill, while the enterprise through which the transaction was initiated may function as an intermediary. By contrast, the enterprise that manages fulfillment network 200 may serve as the merchant of record for items 10 fulfilled out of the enterprise's own fulfillment centers 100*a-c*, or by contract fulfillment entity 210. As with contract fulfillment entity 210, any suitable cost arrangement for fulfillment services may be implemented between the enterprise and merchants 220. For example, a particular merchant 220 may pay a per-item or per-order commission or a flat subscription fee to the enterprise in exchange for order traffic.

By provisioning a network 200 that includes a number of fulfillment entities, an enterprise may be able to tune its inventory mix and placement in order to reduce its fulfillment costs and increase revenues. For example, in a homogeneous network such as network 200*a*, an enterprise may be able to position inventory closer to customers, reducing shipping costs. In a heterogeneous network such as network 200*b*, an enterprise may elect to fulfill certain types of items 10 from its own fulfillment centers 100, such as items 10 having high margins or relatively low costs of storage and fulfillment, while it may rely on other parties for fulfillment of other types of items 10. For certain items 10, an enterprise may elect to allow a third-party merchant 220 to act as the merchant of record as described above, while retaining fees for services provided to the merchant 220 in attracting and processing the order.

Although two specific example of fulfillment networks 200 have been described above, it is contemplated that in other embodiments, a fulfillment network 200 may include any suitable combination of fulfillment entities. For example, a network 200 may include a combination of fulfillment centers 100 and contract fulfillment providers 210 without merchants 220, may include merchants 220 while omitting contract providers 210, or may include any other combination of entities. It is also noted that various embodiments of fulfillment network 200 may have more or fewer entities than those shown. Further, in some embodiments there may be some degree of overlap among items 10 available for fulfillment from various entities within the fulfillment network 200. For example, while some items 10 may be available exclusively from a particular fulfillment center 100, contract fulfillment provider 210 or merchant 220, other items 10 may be available from combinations of these or other entities.

To process orders within fulfillment networks 200*a-b*, an enterprise may provide an enterprise order management system 250. In the illustrated embodiment, order management system 250 may be configured to receive customer orders for various items 10. For example, order management system 250 may be configured to implement an electronic or web-based interface through which a customer or a customer's agent may browse and select items 10 for an order, provide payment details, and/or complete other tasks relevant to the ordering process. Order management system 250 may be configured to communicate with various entities within fulfillment network 200*a* or 200*b* via communication network 260. In various embodiments, network 260 may support internet-based data communication (e.g., using web-based or web-services-based data transport protocols) and/or other types of communication such as dial-up telephony, facsimile, etc. using standard or proprietary communication protocols. In response to placement of a customer order, order management system 250 may be configured to communicate fulfillment instructions to one or more entities within fulfillment network 200, as described in greater detail below.

Figure 3:
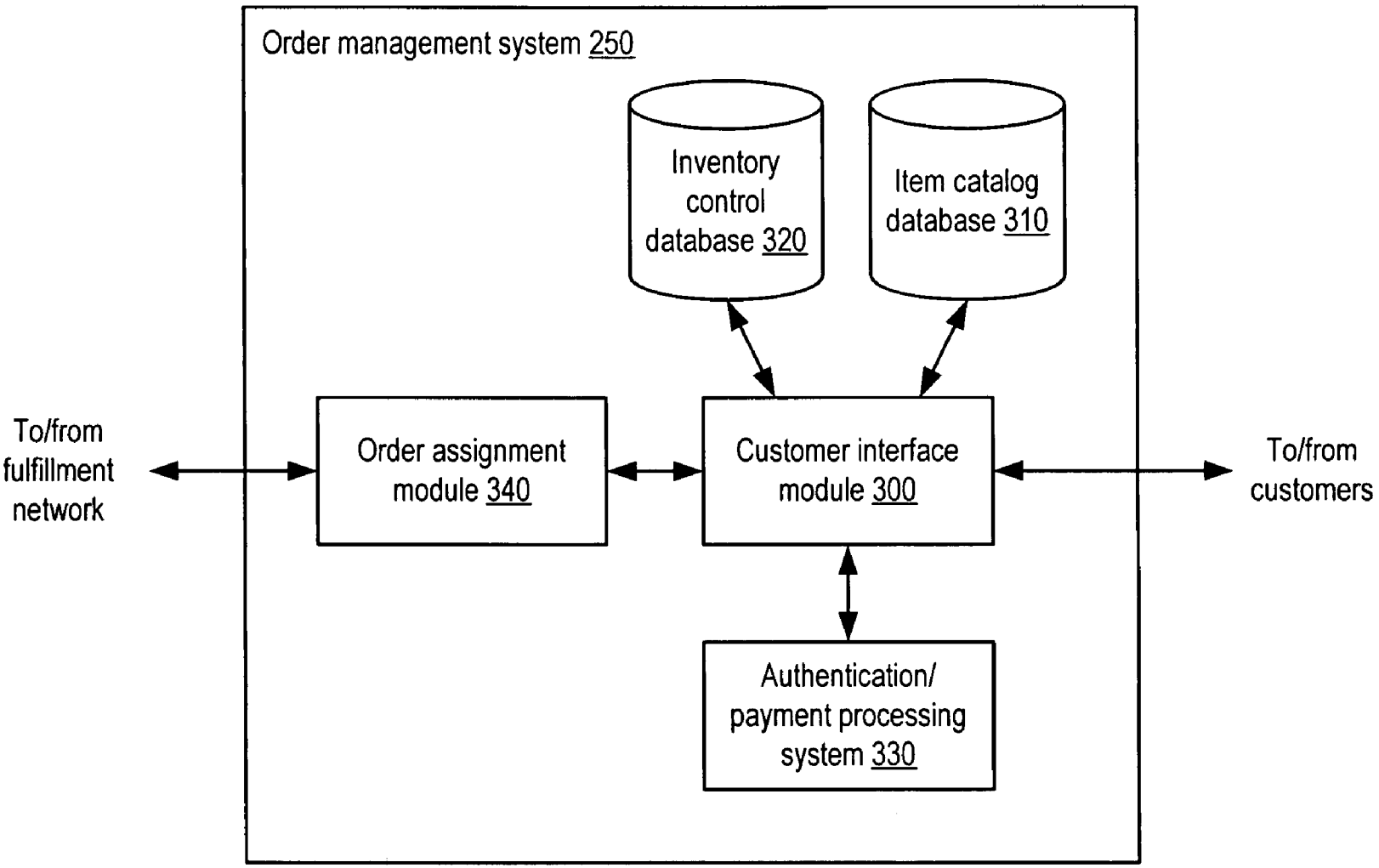
FIG. 3 is a block diagram illustrating one embodiment of an order management system.

One embodiment of order management system 250 is illustrated in FIG. 3. In the illustrated embodiment, order management system 250 includes a number of functional components that may be collectively configured to implement procedures for receiving customer orders and arranging for orders to be fulfilled. As shown, order management system 250 includes a customer interface module 300, an item catalog database 310, an inventory control database 320, an authentication and payment processing system 330, and an order assignment module 340.

In one embodiment, customer interface module 300 may be configured to present an interface through which enterprise customers may obtain information about and place orders for various items 10. For a web-based enterprise, one embodiment of customer interface module 300 may be configured to implement a web site navigable by customers to search for and identify items of interest. For example, customer interface module 300 may be configured to implement customer-navigable web pages corresponding to the various items 10 available for ordering through the enterprise. Such web pages may include detailed item information that may be drawn from item catalog database 310. In some embodiments, item catalog database 310 may be configured to store item-specific information such as identifying codes, specifications, dimensions, images, descriptive content such as text, audio or video content, and/or other item-specific information. In some embodiments, item catalog database 310 may also include item price information, although in other embodiments price information may be stored and managed separately from other descriptive item information. It is contemplated that the type and amount of information stored and displayed may vary for different ones of items 10.

Inventory control database 320 may be configured to track the current inventory state of various items 10 within a fulfillment network 200. For example, in some embodiments inventory control database 320 may be configured to track the number of units of items 10 stored by various fulfillment entities that are available for ordering, committed to previous orders but not yet shipped, en route from suppliers, damaged or spoiled, or any other suitable type of inventory state information. Inventory control database 320 may also be configured to determine item availability information for various items 10 from fulfillment entities within a network 200, which may take into account factors such as the quantity of available inventory within network 200, outstanding fulfillment operations in process within the fulfillment entities, expected arrival of items 10 en route from or to be ordered from suppliers, and/or other factors affecting item lead time or availability. In some embodiments, inventory control database 320 may provide availability information to customer interface module 300 for display to customers. For example, in response to a customer's browsing for information on a particular item 10, customer interface module 300 may retrieve item-specific information from item catalog database 310 as well as an estimated delivery lead time from inventory control database 320, and may display this information to the customer within one or more web pages.

Customer interface module 300 may also be configured to present an ordering or shopping interface through which a customer may select one or more particular items 10 for an order, specify order details such as delivery options and addresses, provide payment information, and/or provide any other data required by the enterprise to process an order. For example, in some embodiments customer interface module 300 may be configured to provide a virtual, web-based "shopping cart" into which customers may place items 10 while browsing through item catalog information. When a customer wishes to complete the ordering process, customer interface module 300 may present the customer with one or more web pages including fillable forms or other suitable input-gathering features to collect payment information and other order details. In the illustrated embodiment, customer interface module 300 may be configured to communicate with authentication and payment processing system 330, which in some embodiments may establish the authenticity of the customer's identity (e.g., by checking account credentials such as a password) and process supplied payment information (e.g., by processing a credit card, conducting an electronic funds transfer, establishing credit terms for future payment, etc.). In some embodiments, customer interface module 300 may support a streamlined ordering interface through which a customer may establish payment, shipping and/or other required details in advance, and may complete the ordering process for an item 10 simply by selecting it (e.g., by clicking an appropriate button on a web page or by placing the item 10 in a virtual shopping cart). In such embodiments, customer interface module 300 may attempt to complete the order using the customer's existing information rather than soliciting such information via a checkout process.

Once sufficient information has been received from a customer to process an order (e.g., as defined by the enterprise), customer interface module 300 may be configured to convey the order to order assignment module 340. As described in greater detail below, order assignment module 340 may be configured to assign the item(s) 10 specified within an order to one or more entities within fulfillment network 200 for fulfillment.

As described above, in some embodiments customer interface module 300 may be configured to support web-based customer interactions, and may be implemented using any suitable techniques for deploying web-based content and applications. For example, customer interface module 300 may be implemented using Hypertext Markup Language (HTML), Common Gateway Interface (CGI), Javascript, PHP, Peri, C/C++, or any suitable combination of these or other commercial, open source and/or proprietary languages, frameworks or development environments for generating and distributing web-based information. As described in greater detail below, in some embodiments customer interface module 300 may also support a web services interface through which various functional aspects of order management system 250 may be exposed to third parties. Additionally, it is noted that in other embodiments, customer interface module 300 may support types of customer interfaces other than web-based interfacing. For example, customer interface module 300 may be configured to present a text and/or graphical interface via dedicated terminals using protocols other than web-based protocols. Alternatively, customer interface module 300 may support customer-interaction via telephony (e.g., using numerical prompts or voice recognition), electronic mail, or any other suitable type of communication technology, including combinations of the aforementioned approaches.

In some embodiments, customer interface module 300 may support a web services interface through which various features of order management system 250 may be accessed. Generally speaking, providing a function or service as a web service may encompass providing any of a variety of standardized application programming interfaces (APIs) configured to allow different software programs to communicate (e.g., to request services and respond to such requests) in an autonomous, web-based and typically platform-independent manner. For example, an enterprise may choose to expose certain enterprise data (e.g., catalog data, inventory data, customer data or other types of data) and/or certain enterprise functions (e.g., fulfillment service request processing functions, query functions, electronic commerce functions, generic data storage or computational functions, etc.) to external clients via a web services interface. Applications could then access the exposed data and/or functions via the web services interface, even though the accessing application may be configured to execute on an entirely different platform (e.g., a different operating system or system architecture) than the platform hosting the exposed data or functions. For example, using web services provided by an enterprise, a third party may generate and deploy a customer browsing and ordering environment for the enterprise that differs substantially from the environment provided by the enterprise itself, potentially providing a different feature set and thereby attracting a different customer base. In some embodiments, various ones of merchants 220 may use web services techniques to integrate their businesses with various features that may be provided by the enterprise, such as payment processing services, inventory catalog data, etc.

In some embodiments, provisioning a web service may encompass the use of particular protocols which may be executable to publish available web services to potential users, to describe the interfaces of web services sufficiently to allow users to invoke web services properly, to allow users to select and differentiate among web services for a particular transaction, and to provide a format for exchanging web services data in a flexible and platform-independent manner. Specifically, in one embodiment a provider of a web service may register the service using a version of the Universal Discovery Description and Integration (UDDI) protocol, which may function as a general directory through which potential resource users may locate web services of interest. The web service provider may also publish specific details regarding how a well-formed web services request from a user should be formatted (e.g., what specific parameters are required or allowed, the data type or format to be used for a given parameter, etc.). For example, such interface details may be published (e.g., within a UDDI directory entry) using a version of the Web Services Description Language (WSDL).

In many embodiments, web services request and response data is exchanged between a client and the service provider through the use of messages or documents formatted as platform-independent structured data, such as a document formatted in compliance with a version of eXtensible Markup Language (XML). For example, in one embodiment a web services request to provide inventory health information for a given inventory item may be embodied in an XML document including fields identifying the item of interest, the type of data requested (e.g., inventory health data), and possibly other fields, in which each field is delimited by an XML tag describing the type of data the field represents. The response to such a request from the web service provider may include an XML document containing the requested data. In some embodiments, web services-related documents may be transmitted between applications making requests and targeted web services using a web-based data transfer protocol, such as a version of the Hypertext Transfer Protocol (HTTP), for example.

Different types of web services requests and responses may yield XML documents that bear little content in common, which may complicate the handling and interpretation of such documents. For example, in different versions of a free-form XML document specifying a web services request, the actual web service that is requested may appear at different places within different document versions, which may require a recipient of the document to buffer or parse a good deal of document data before understanding what the document is for. Consequently, in some embodiments, the XML documents containing web services request/response data may encapsulated within additional XML data used to define a messaging framework, e.g., a generic format for exchanging documents or messages having arbitrary content. For example, in one embodiment web services requests or responses may be XML documents formatted according to a version of the Simple Object Access Protocol (SOAP), which in various versions may define distinct document sections such as an "envelope" (e.g., which may include a specification of the document type, the intended recipient web service, etc.) as well as a message body that may include arbitrary XML message data (e.g., the particular details of the web services request). However, in some embodiments, web services may be implemented using different protocols and standards for publishing services and formatting and exchanging messages.

Additionally, in some embodiments, a web services system may be implemented without using document-based techniques such as SOAP-type protocols. For example, as an alternative to a document-based approach, a web service may be implemented using a Representational State Transfer (REST)-type architecture. Generally speaking, in REST-type architectures, web services requests may be formed as commands conveyed via a transport protocol, such as PUT or GET commands conveyed via a version of the HTTP protocol. Those parameters of the request that might be embedded within a document in a document-based web services architecture may instead be included as command parameters in a REST-type architecture. Other suitable configurations of web services architectures are possible and contemplated.

In various embodiments, each of the different components of order management system 250 may be implemented in software, hardware or a suitable combination thereof, in an integrated fashion (e.g., on a single computer system) or in a distributed fashion (e.g., via a number of discrete systems configured to communicate with one another via a network). It is noted that in some embodiments, the functionality of order management system 250 may be partitioned into components in a different fashion than that illustrated in FIG. 3. Also, in some embodiments, order management system 250 may include additional functionality not described here, or may omit or consolidate various illustrated components.

Assigning Orders for Fulfillment

In some embodiments, an enterprise may elect to partially or completely hide the details of its fulfillment network 200 from customers. For example, while interacting with the enterprise via order management system 250 in such an embodiment, customers may be given limited or no information regarding the various fulfillment entities from which their ordered items 10 may be delivered. Rather, from the perspective of customers, the enterprise may appear to be a single, virtual fulfillment center possibly having varying lead times for different items 10. Alternatively, an enterprise may present certain items 10 as being available to be fulfilled by merchants 220, and may distinguish transactions involving such items 10 from other items 10 for which the enterprise acts as the merchant of record. However, in such an embodiment, the enterprise may provide limited customer visibility into the details of item availability within its own fulfillment centers 100 or the facilities of its contract fulfillment providers 210.

Providing few details to customers regarding how items 10 may be fulfilled may simplify the customer ordering experience, in some instances. For example, a prospective customer shopping for a given item 10 may simply be informed whether or not the given item 10 is available (e.g., is ready or expected to be ready for fulfillment from some entity within fulfillment network 200), possibly with an estimate as to the lead time that may be expected for the given item 10. The customer may then decide whether or not to order the given item 10.

However, by limiting customer visibility into details of its fulfillment network 200, under certain circumstances an enterprise may encounter logistical challenges and increased order fulfillment costs. For example, a particular customer may place an order for a number of different items 10. However, all of the ordered items 10 may not be available from a single entity within fulfillment network 200 within a timeframe for processing the particular customer's order, such as a promised delivery date. For example, some of the items 10 may be present within one fulfillment center 100, while the remainder are located in one or more different fulfillment centers 100. While it may be possible to reorder or reallocate inventory such that all items 10 of the particular customer's order are located within a single entity within fulfillment network 200, it may not be feasible to do so within a timeframe that is acceptable to the customer. Consequently, the enterprise may not be able to avoid splitting fulfillment of the particular customer's order across two or more entities within fulfillment network 200. Such splitting may increase fulfillment costs substantially. For example, the labor, materials, service-related and other costs for picking, packaging and shipping an order from two or more fulfillment centers 100 or other entities may be considerably greater than if the entire order had been fulfilled by a single fulfillment entity.

As orders are placed by customers, they may be assigned or mapped to entities within fulfillment center 200 for fulfillment, for example by order assignment module 340 within order management system 250. The costs of split orders may create a strong incentive for attempting to assign as many complete orders as possible to single entities within fulfillment network 200. Such a goal may increase the complexity of the assignment algorithm employed by order management system 250. For example, to assign orders for fulfillment, order management system 250 may take into account both fulfillment cost and fulfillment capacity, considering factors such as: the current availability of inventory within entities of fulfillment network 200, the ability or capacity of entities to timely process orders (e.g., as indicated by a backlog or forecast of fulfillment activity), the expected shipping costs and shipping times from various entities to a particular customer, and/or other relevant order assignment criteria. Order management system 250 may then attempt to assign orders for fulfillment such that on average, the costs associated with fulfillment are minimized while orders are fulfilled in a timely fashion. Accounting for the possibility of split orders may increase the size of the order assignment decision space, since there may be a number of possible ways in which an order may be split. Numerous such combinations may need to be considered in order to reduce costs associated with a given split order.

The prospect of split orders may be influenced by the manner in which inventory is allocated among entities within fulfillment network 200. For example, to the extent that numerous entities within fulfillment network 200 each have comprehensive selections of the items 10 that form the total available catalog of an enterprise, split likelihood may be reduced, since it may be probabilistically likely that at least one entity within fulfillment network 200 will have in stock each item 10 that may be specified in any given customer order. However, it may be costly to replicate a comprehensive selection of items 10 throughout fulfillment network 200. For example, regional variations in demand for certain items 10 may suggest that item selection in a given fulfillment center 100 or other entity located in a given region should be tuned to the expected ordering demands of that region. Given finite inventory storage capacity within a fulfillment entity, tuning its inventory selection for local demand may compete with providing a comprehensive selection to reduce the risk of split orders. Failure to correctly predict customer demand and to store inventory accordingly may result in an inability to timely satisfy regional demand (e.g., if popular items 10 are displaced in favor of providing coverage against splits) or the occurrence of split orders with their associated increased costs. Thus, inventory management to reduce split orders may create challenges both in the way inventory items 10 are allocated and stored across fulfillment network 200, and in the complexity of order management algorithms for dynamically assigning orders for fulfillment, as described above.

Transparent Fulfillment Options

An enterprise may offer items 10 to be ordered by customers, the majority or entirety of which often may be fulfilled by its own fulfillment centers 100. However, in a typical system in which customer visibility into the detailed status of fulfillment network 200 is limited as described above, the enterprise may simply indicate to a customer that a given item 10 is generally available without indicating the particular fulfillment centers 100 from which the given item 10 is in fact available. Further, the enterprise may present an item price to the customer that does not reflect the differences in costs that may exist to fulfill given item 10 from different fulfillment centers 100. For example, the enterprise may present a fixed shipping charge for given item 10 irrespective of the actual costs to ship given item 10 from various fulfillment centers 100, which may vary according to geography and other factors.

Figure 4:
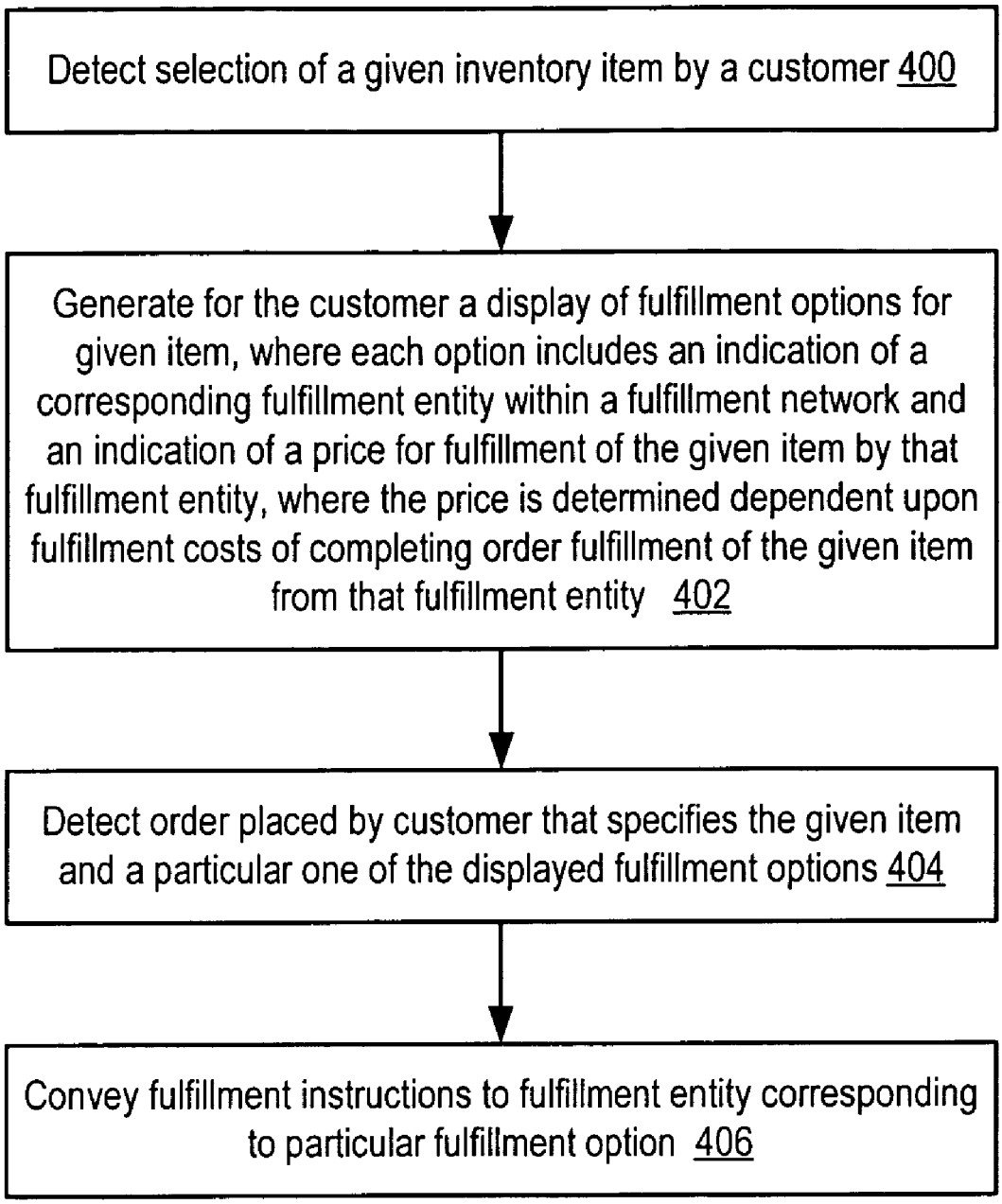
FIG. 4 is a flow diagram illustrating one embodiment of a method of transparently providing fulfillment costs to customers.

In contrast to this approach, the costs and complexities associating with splitting orders among different entities within fulfillment network 200 may be reduced in some embodiments by making fulfillment options and their associated costs transparent to customers, and by allowing customers at least some degree of control as to how their orders will be assigned within fulfillment network 200 for fulfillment. One embodiment of a general method of transparently providing fulfillment costs to customers is illustrated in FIG. 4. In some embodiments, the illustrated method may be implemented within order management system 250, or by another system configured to communicate with order management system 250, via hardware, software or a combination thereof. For example, the illustrated method may be implemented entirely or in part by customer interface module 300 described above, or by other components of order management system 250.

Operation of the method begins in block 400 where the selection of a given one of inventory items 10 by a customer is detected. For example, customer interface module 300 may be configured to detect the selection of a given inventory item 10 when the given item 10 is placed in a virtual shopping cart in response to the customer's interaction with a web page displaying the given item 10 (e.g., navigating a link, pressing a button, or any other suitable type of customer interaction). In some embodiments, detecting the selection of a given item 10 may include detecting any sort of customer interaction attributable to the given item 10. For example, a customer selection may be detected when, in response to a user navigating a link, entering search criteria into a search function, or performing any other type of selection activity, the customer is presented with information pertaining to given item 10, such as a product information page. That is, selection of given item 10 may be detected in response to detection of any event evidencing interest in given item 10 on the part of a customer, regardless of whether such an event includes placing the given item 10 in a shopping cart or otherwise evidencing intent to purchase the given item 10.

In response to detecting the selection of a given item 10, a display of a number of fulfillment options for the given item 10 may be generated for the customer (block 402). In one embodiment, each fulfillment option within the display may include an indication of a corresponding fulfillment entity within a fulfillment network 200 and an indication of a corresponding price for fulfillment by that fulfillment entity. In some embodiments, each displayed fulfillment option may include additional information, such as an expected lead time for the given item 10 from the corresponding fulfillment entity. In one embodiment, the displayed price may be determined dependent upon a total cost of completing order fulfillment of the given item 10 for the customer from the corresponding fulfillment entity, including fulfillment costs specific to the corresponding fulfillment entity. For example, fulfillment costs such as shipping costs may vary based on the distance from a given fulfillment entity to the customer, and displayed costs may reflect this variation.

Generally speaking, fulfillment costs may include any costs that may be specifically attributable to the fulfillment of a particular item 10 from a fulfillment entity. For example, fulfillment costs may include accrued, prorated or amortized costs of storing item 10 within a fulfillment center 100, such as a share of the operating costs of the fulfillment center 100 determined according to the area, volume, weight or other defining characteristic of the particular item 10. If an item 10 requires special handling or storage conditions, such as, e.g., climate or environmental control, in some embodiments the incremental costs of such storage conditions may be imputed to item 10 as part of its fulfillment costs. Fulfillment costs may also include labor costs associated with storing, picking, and packaging an item 10, materials costs associated with preparing an item for delivery to a customer (e.g., packing materials, shipping containers, labels, printed manifests or receipts, etc.), and/or service-related costs associated with conveying an item 10 to a customer, such as costs for shipping services provided by an in-house or third-party shipper. While fulfillment costs may include any of these or other costs attributable to fulfillment of items 10, in some embodiments an enterprise may elect not to include certain types of fulfillment costs in the pricing presented to a customer. It is contemplated that in some embodiments, an enterprise may determine fulfillment costs for an item 10 based on a cost schedule defined in terms of item characteristics, such as its physical dimensions, qualitative characteristics such as fragility or perishability, the item's classification within a product categorization scheme (e.g., books, media, electronics, appliances, etc.) or any other suitable types of item characteristics or combinations thereof.

One embodiment of a display of fulfillment options that may be generated for a customer is illustrated in FIG. 5A. In the illustrated embodiment, display 500 may correspond to at least a portion of a web page as may be generated, e.g., by customer interface module 300, conveyed to a customer's computer or other display device (e.g., via the Internet) and rendered by a web browser (e.g., a version of Microsoft Internet Explorer™, Mozilla Firefox, or another suitable browser application) or any other type of application suitable for displaying web-based content. The browser or other application may be configured to execute on a computer or display device associated with the customer. Within display 500, three different fulfillment options 510 are shown for a given item 10 (denoted Item A within display 500). Each option includes a corresponding price, an indication of a corresponding fulfillment entity, and an indication of an expected shipping timeframe from the fulfillment entity, as well as a navigable link through which the customer may select a particular one of the options.

For example, as shown, Item A is available for a total price of $5.99 from fulfiller "Enterprise FC—San Francisco" with expected shipping within 24 hours, for a total price of $6.50 from fulfiller "Enterprise FC—Chicago" with expected shipping within 3-4 days, and for a total price of $7.75 from fulfiller "Enterprise FC—Boston" with expected shipping within 1-2 days. It is noted that in various embodiments, more or fewer fulfillment options 510 may be generated for display to the customer, and the options 510 may include information fields other than those shown. It is also noted that while the illustrated embodiment displays only options 510 corresponding to enterprise fulfillment centers 100 within a fulfillment network 200, in other embodiments options 510 corresponding to any entity within a fulfillment network 200 may be shown.

In some embodiments, the displayed price for a given fulfillment option may be broken down into an item price portion and a fulfillment cost portion. FIG. 5B illustrates one embodiment of such a display. It is noted that while the item price is shown as being consistent across the different fulfillment entities, in other embodiments both the item price and fulfillment cost may vary for different entities.

In one embodiment, customer interface module 300 may be configured to generate displays of fulfillment options for a given item 10 selected by a customer. For example, customer interface module 300 may be configured to query other components of order management system 250, such as item catalog database 310 and/or inventory control database 320, in order to obtain information about item pricing and availability from various entities within fulfillment network 200. In some embodiments, fulfillment costs for a given item 10 may be statically computed and stored prior to detection of a customer's selection of the given item 10. For example, inventory control database 320 may include a record of fulfillment costs for the given item 10 for each fulfillment center 100 or other entity from which the given item 10 is available. In some embodiments, for each entity, the stored record may further specify fulfillment costs broken down by a customer-specific variable, such as by destination geographic regions.

As an alternative to static determination of fulfillment costs, in some embodiments customer interface module 300 may be configured to dynamically compute fulfillment costs of various fulfillment options in response to detecting customer selection of a given item 10. For example, customer interface module 300 may be configured to query inventory control database 320 to determine availability of the given item 10 from various fulfillment entities, and may compute a cost function for each of the fulfillment options to be displayed. In some embodiments, the cost function may take into account customer-invariant costs that are specific to a particular fulfillment entity as well as customer-variable costs, such as the customer's geographic location and any preferences the customer may have established as described in greater detail below.

As illustrated in FIGS. 5A-B, in some embodiments display 500 may be configured to show multiple fulfillment options corresponding to a single given item 10. For example, display 500 may be configured to be presented to a customer in response to the customer selecting the given item 10 for placement in a virtual shopping cart or for completion of an expedited ordering process, or as part of a display of other information about the given item 10 (e.g., as part of a product web page displaying various types of catalog information). However, it is contemplated that display 500 need not be restricted to displaying fulfillment options 510 for only a single item 10. In some embodiments, display 500 may show multiple different items 10 (e.g., those items 10 that satisfy a customer's keyword search or query, those items 10 that fall within a particular product category selectable by the customer, or any other suitable grouping of items 10 for display) and may show multiple different fulfillment options 510 for some or all of the multiple displayed items 10.

It is further contemplated that the amount of detail shown with respect to displayed fulfillment options 510 may vary dependent upon the context in which the options are displayed. For example, in contexts where multiple items 10 appear within display 500, less detail regarding fulfillment options 510 may be shown, such as by omitting or abbreviating certain fields of options 510. Conversely, when a single item 10 is displayed (or, in some embodiments, when fewer than a threshold number of items 10 are displayed), more detail regarding fulfillment options 510 may be shown.

Returning to FIG. 4, subsequent to generating the display of fulfillment options for the given item 10, an order placed by the customer that specifies the given item 10 and a particular one of the displayed fulfillment options may be detected (block 404). For example, the customer may submit an order by proceeding through a checkout process, as described above with respect to FIG. 3. In some embodiments where customer interface module 300 is configured to present a streamlined checkout procedure to a customer based on existing customer details (e.g., payment and shipping details already on file), detection of an order may include detection of the customer's selection of a particular displayed fulfillment option. In other embodiments, it is contemplated that specification of the particular fulfillment option may be dependent upon the customer's defined ordering preferences or defaults as described below, rather than on an active selection by the customer in response to the generated display of fulfillment options.

Fulfillment instructions for the given item 10 may then be conveyed to the fulfillment entity corresponding to the particular fulfillment option (block 406). For example, order assignment module 340 may be configured to receive an order from customer interface module 300, to parse the various items 10 included within the order, and to generate fulfillment instructions and convey them to corresponding entities within fulfillment network 200 for fulfillment of the ordered items 10. It is noted that in some embodiments where fulfillment options for ordered items 10 are specified directly or indirectly by a customer, the implementation of order assignment module 340 may be considerably simplified. For example, rather than performing a complex optimization to minimize fulfillment costs and avoid splitting of orders, customer-transparent fulfillment options may allow order assignment module 340 to simply route fulfillment instructions according to customers' specifications. Additionally, by making fulfillment costs transparent to customers, the costs of split orders that are directly borne by the enterprise may be reduced or eliminated. For example, if for a given order a customer selects two items 10 that are not within the same fulfillment center 100, the fulfillment options presented to the customer according to the method of FIG. 4 may reflect the costs to the enterprise of fulfilling the items separately.

In some embodiments, as a customer selects additional items for a given order, customer interface module 300 may be configured to allow the customer to revise selected fulfillment options for previously-selected items 10 in view of the order as a whole. For example, a customer may select a first item 10 and select a corresponding fulfillment option specifying a first fulfillment center 100 having the shortest shipping lead time. The customer may then select a second item 10 that is not available from a second fulfillment center 100, but not the first fulfillment center 100. In one embodiment, customer interface module 300 may be configured to take the previous state of the customer's shopping into account when evaluating fulfillment options for the second item 10. If the first item 10 is available from the second fulfillment center 100, the customer may be notified that selecting the second fulfillment center 100 as the fulfillment option for both items 10 may reduce the total fulfillment cost for the order, possibly (though not necessarily) at the expense of a longer shipping lead time for the first item 10. If the customer chooses not to consolidate fulfillment of the items, he or she may incur additional fulfillment costs associated with the items being fulfilled separately. That is, the customer may be given the option whether to incur split costs or not.

As just described, in some embodiments customer interface module 300 may be configured to allow a customer to select a particular fulfillment option subsequent to selecting a first item 10, and then allow the customer to subsequently revise the selected fulfillment option for the first item 10 in view of the options available for a second or subsequently selected item 10. That is, customer interface module 300 may allow for a customer to sequentially select fulfillment options as items 10 are selected, prior to the selection of other items 10.

However, alternative embodiments are possible and contemplated. In one embodiment, customer interface module 300 may be configured to allow a customer to select multiple items 10 for an order. Subsequently, customer interface module 300 may allow the customer to select fulfillment options for the various multiple items 10 in view of the order as a whole. In some embodiments, customer interface module 300 may be configured to group the multiple selected items 10 within display 500 according to aspects of their corresponding fulfillment options 510. Such groupings may be made in view of customer preferences or defaults. For example, the items 10 selected by a customer for a particular order may be displayed in groups that minimize the total cost of fulfillment of the items 10, that minimize the lead time or delivery time for the greatest number of items 10, or that accomplish some other goal specified by the customer. A customer may accept the suggested groupings displayed by customer interface module 300 or may make changes. For example, the customer may prefer to receive a particular item 10 sooner rather than minimize fulfillment costs by waiting for the particular item 10 to be shipped with another item 10, and may correspondingly override a suggested grouping of the particular item 10 with the other item 10. In some embodiments, customer interface module 300 may be configured to present multiple different grouping options to a customer for selection, such as one grouping that minimizes total fulfillment costs and another that minimizes delivery time.

One example of an embodiment of display 500 configured to display alternative groupings of items 10 for order fulfillment is shown in FIG. 5C. In the illustrated embodiment, display 500 reflects that a customer has selected two items 10, denoted A and B, for an order. As mentioned previously, display 500 may be presented to the customer at any suitable point during the customer's shopping experience. For example, display 500 may be presented once a customer has indicated that all desired items 10 have been selected and the order process is to be completed (e.g., via a checkout process). Alternatively, display 500 may be presented in response to detecting that a customer has selected multiple items 10, but possibly before completion of the ordering process.

In the illustrated embodiment, display 500 reflects two possible groupings of items A and B. In the first grouping, both items are available from the same fulfillment center with the same lead time. In the second grouping, the items are available from different fulfillment centers, and one of the items is expected to ship sooner than the other. As shown, the total cost for the order according to the second grouping reflect the increased costs of fulfillment associated with fulfilling the order from two different sources relative to the first grouping, in which both items may be fulfilled together. If the customer wishes to receive item A sooner than item B, he or she may select the second grouping for order fulfillment at a higher overall cost. Alternatively, the customer may save money by selecting the first grouping and accepting a slightly longer delay in receiving the items. In the illustrated embodiment, an additional option is provided for the user to specify groupings other than those illustrated. When selected, display 500 may show additional possible groupings or may display various fulfillment options for individual items 10 such as in the manner of FIGS. 5A-B.

It is noted that numerous variations on the configuration and content of display 500 are possible and contemplated. For example, display 500 may be configured to explicitly break out fulfillment costs separately from item costs such as shown in FIG. 5B. In some embodiments display 500 may explicitly show the difference in total costs between different groupings. As noted previously, the manner in which various groupings are shown with display 500 may depend on preferences established by the customer. For example, a customer may specify a preference for minimizing total order costs where possible. Correspondingly, display 500 may display the lowest-cost grouping first to such a customer.

The manner in which fulfillment options are generated and/or selected on behalf of a customer may, in some embodiments, be influenced by the customer's previously determined preferences or default settings. For example, in one embodiment order management system 250 may support the generation of persistent customer accounts or profiles. A given customer may establish such an account with a unique identifier (e.g., an email address, account name or number, etc.) and, optionally, a credential such as a password. When the given customer is identified during interactions with order management system 250 (e.g., by supplying the unique identifier and credential, or through passive techniques such as web browser cookies), the customer's preferences may be applied to fulfillment option generation and selection. Such preferences may include, for example, specifying a minimum or maximum number of fulfillment options to be generated, and/or limiting the generated options by one or more criteria. Example criteria may include ordering the options according to cost, shipping lead time, or limiting display of fulfillment options to situations where cost, lead time or other aspects of the options differ by a certain amount (such as a minimum percentage difference). Customer preferences may also specify default selections for situations where the customer omits making a particular fulfillment option selection (e.g., in instances where the customer engages in a streamlined ordering or checkout procedure that bypasses the usual fulfillment option selection process). For example, a customer may specify that in the absence of an overriding fulfillment option selection, the lowest-cost, lowest-lead-time or other specified type of fulfillment option should be selected.

It is contemplated that in some embodiments, customer selections of fulfillment options with respect to various items 10 may be analyzed and taken into account in future inventory placement within fulfillment network 200. For example, making fulfillment costs transparent to customers may effectively result in different fulfillment entities "competing" for customer selection. If a particular fulfillment center 100 lacks a particular item 10 at the time a customer places an order, but could fulfill the particular item 10 more cheaply than the fulfillment entity that was ultimately selected, units of the particular item 10 may be stocked at the particular fulfillment center 100 in anticipation of future customer orders. Similarly, if customers are willing to pay a premium in fulfillment costs for split orders of some combinations of items 10, those combinations may be examined to determine whether they should be stocked together within one or more entities of fulfillment network 200 in order to take advantages of efficiencies of inventory collocation. Such efficiencies may result in fulfillment cost reductions that may be passed along to customers, retained as profit, or a combination of the two. More generally, exposing fulfillment costs as transparent costs to customers may facilitate market-based inventory management decisions. That is, such an approach may enable an enterprise to determine the efficacy of its inventory placement strategies on the basis of customer feedback in the form of fulfillment option decisions, including instances where customers may change the composition of their orders based on fulfillment options (e.g., by removing selected items 10 from an order if fulfillment options for those items are deemed unacceptable).

Presenting transparent fulfillment costs to customers may also simplify the manner in which an enterprise may deploy value-added fulfillment services within fulfillment network 200. For example, an enterprise may wish to provide special services such as gift wrapping, binding services for books or publications, pre-assembly of certain types of merchandise, print-on-demand publishing services for certain types of printed matter, or other types of services selectable by customers for an additional fee when ordering items 10. The enterprise may face a choice: either deploy a special service within only one or a few entities within a fulfillment network 200, or deploy the service widely within the fulfillment network 200. In a situation where an enterprise does not present transparent fulfillment costs to customers, either option may present a cost-management problem: if the enterprise deploys the service in only one fulfillment center 100, for example, it may incur substantial fulfillment costs to ship an item 10 ordered with the service to a distant customer. In the alternative, replicating the service in multiple fulfillment centers 100 may reduce the average distance and shipping costs to customers, but potentially at considerable capital and operational expense to provide the service from different locations. Such an investment may be particularly risky where there is uncertainty as to the degree customers will adopt a new service.

By contrast, presenting the fulfillment costs for value-added services as transparent costs to customers may mitigate the risk in deploying such services. Customers may determine whether the value of a service is worthwhile given the cost of receiving the service from a particular entity within fulfillment network 200, and the enterprise may experiment with service pricing in view of fulfillment costs to balance profitability with customer demand. In a transparent-cost environment, customers may drive the degree to which services are replicated within fulfillment network 200. For example, if a service proves to be popular, the enterprise may choose to increase its availability within fulfillment network 200, and may choose to pass along fulfillment cost savings to customers, retain such savings as profit, or a combination of these.

Presenting transparent fulfillment costs to customers may also simplify the degree to which an enterprise manages utilization of fulfillment services or value-added services within fulfillment network 200. For example, if a particular fulfillment center 100 is especially busy or a particular service (e.g., gift wrapping) is highly utilized at a particular time, order management system 250 may be configured to dynamically increase the fulfillment costs presented to customers for fulfilling items from the particular fulfillment center 100 or using the particular service in order to balance demand with capacity. Conversely, during times of lower utilization of a particular fulfillment entity or service, the associated fulfillment costs may be decreased in order to increase demand. In some embodiments, certain fulfillment entities or services may be entirely disabled from being selected by customers, for example to take such entities or services offline for maintenance or to control utilization.

Exemplary Computer System Hardware

It is contemplated that in some embodiments, any of the methods, techniques or components described above may be implemented as instructions and data capable of being stored by a tangible, computer-accessible storage medium. Such methods or techniques may include, for example and without limitation, the method of generating a display of fulfillment options for presentation to a customer shown in FIG. 4 and described in detail above, as well as suitable variations thereof, and any of the various components of order management system 250 described above. Such instructions may be executed to perform a particular computational function, such as performing inter-process communication, implementing mathematical functions for inventory data analysis, optimization, etc., as well as higher-order functions such as operating system functionality, network communications functionality, application functionality, and/or any other suitable functions. It is noted that for any method described above, where no specific ordering of operations of a method is described or required, the various operations of the method may be performed in any suitable order by instructions that may be executed in any suitable order.

Figure 6:
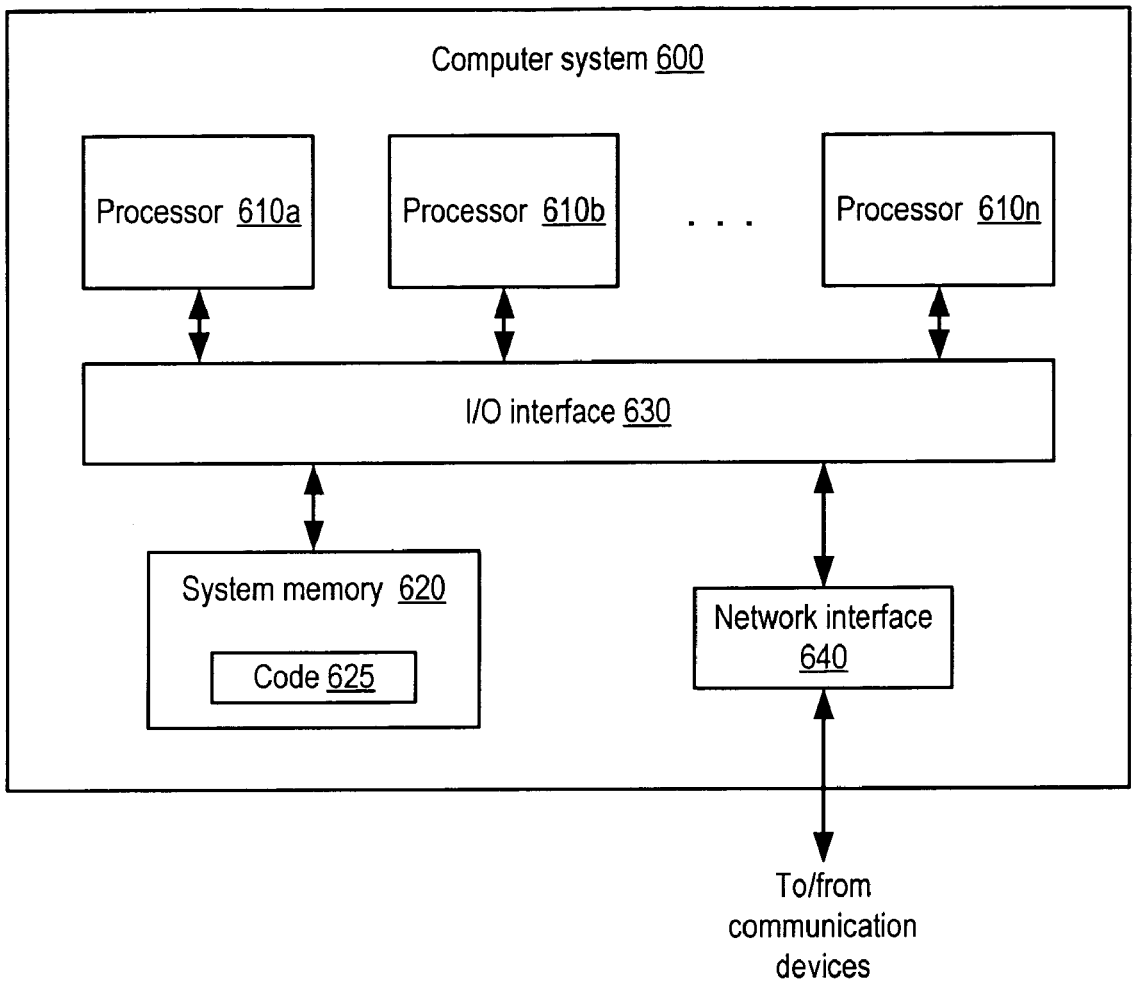
FIG. 6 is a block diagram illustrating an exemplary embodiment of a computer system.

One embodiment of a computer system includes or is configured to access one or more tangible, computer-accessible storage media is illustrated in FIG. 6. Such a system may also be referred to as a node. In one embodiment, the functionality of any of the various components of order management system 250 described above may be distributed across a number of nodes, such that a given component may be implemented by one or more nodes or partitioned across several nodes. While in some embodiments, a node may exclusively implement the functions of a single order management system component, in other embodiments a node may implement the functionality of all or portions of several different system components. In the illustrated embodiment, computer system 600 includes one or more processors 610 coupled to a system memory 620 via an input/output (I/O) interface 630. Computer system 600 further includes a network interface 640 coupled to I/O interface 630.

In various embodiments computer system 600 may be a uniprocessor system including one processor 610, or a multiprocessor system including several processors 610 (e.g., two, four, eight, or another suitable number). Processors 610 may be any suitable processor capable of executing instructions. For example, in various embodiments processors 610 may be a general-purpose or embedded processor implementing any of a variety of instruction set architectures (ISAs), such as the x86, PowerPC, SPARC, or MIPS ISAs, or any other suitable ISA. In multiprocessor systems, each of processors 610 may commonly, but need not necessarily, implement the same ISA.

System memory 620 may be configured to store instructions and data accessible by processor 610. In various embodiments, system memory 620 may be implemented using any suitable memory technology, such as static random access memory (SRAM), synchronous dynamic RAM (SDRAM), nonvolatile/Flash-type memory, or any other type of memory. In the illustrated embodiment, instructions and data implementing desired functions, methods or techniques, such as those described above, are shown stored within system memory 620 as code 625. It is noted that in some embodiments, code 625 may include instructions and data implementing desired functions that are not directly executable by processor 610 but are represented or encoded in an abstract form that is translatable to instructions that are directly executable by processor 610. For example, code 625 may include instructions specified in an ISA that may be emulated by processor 610, or by other code 625 executable on processor 610. Alternatively, code 625 may include instructions, procedures or statements implemented in an abstract programming language that may be compiled or interpreted in the course of execution. As non-limiting examples, code 625 may include code specified in a procedural or object-oriented programming language such as C or C++, a scripting language such as perl, a markup language such as HTML or XML, or any other suitable language.

In one embodiment, I/O interface 630 may be configured to coordinate I/O traffic between processor 610, system memory 620, and any peripheral devices in the device, including network interface 640 or other peripheral interfaces. In some embodiments, I/O interface 630 may perform any necessary protocol, timing or other data transformations to convert data signals from one component (e.g., system memory 620) into a format suitable for use by another component (e.g., processor 610). In some embodiments, I/O interface 630 may include support for devices attached through various types of peripheral buses, such as a variant of the Peripheral Component Interconnect (PCI) bus standard or the Universal Serial Bus (USB) standard, for example. In some embodiments, the function of I/O interface 630 may be split into two or more separate components, such as a north bridge and a south bridge, for example. Also, in some embodiments some or all of the functionality of I/O interface 630, such as an interface to system memory 620, may be incorporated directly into processor 610.

Network interface 640 may be configured to allow data to be exchanged between computer system 600 and other devices attached to network 120, such as other computer systems, for example. In particular, network interface 640 may be configured to allow communication between computer system 600 and the various communication devices 1010 described above. Network interface 640 may commonly support one or more wireless networking protocols (e.g., Wi-Fi/IEEE 802.11, or another wireless networking standard). However, in various embodiments, network interface 640 may support communication via any suitable wired or wireless general data networks, such as other types of Ethernet network, for example. Additionally, network interface 640 may support communication via telecommunications/telephony networks such as analog voice networks or digital fiber communications networks, via storage area networks such as Fibre Channel SANs, or via any other suitable type of network and/or protocol.

In some embodiments, system memory 620 may be one embodiment of a tangible, computer-accessible storage medium configured to store instructions and data as described above. However, in other embodiments, instructions and/or data may be received, sent or stored upon different types of computer-accessible storage media. Generally speaking, a computer-accessible storage medium may include memory media such as magnetic or optical media, e.g., disk or CD/DVD-ROM coupled to computer system 600 via I/O interface 630. A computer-accessible medium may also include any volatile or non-volatile media such as RAM (e.g. SDRAM, DDR SDRAM, RDRAM, SRAM, etc.), ROM, etc, that may be included in some embodiments of computer system 600 as system memory 620 or another type of memory. A computer-accessible medium may generally be accessible via transmission media or signals such as electrical, electromagnetic, or digital signals, conveyed via a communication medium such as a network and/or a wireless link, such as may be implemented via network interface 640.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A method, comprising:

one or more enterprise computers of an enterprise detecting a selection by a customer of a plurality of inventory items, wherein said enterprise includes a plurality of fulfillment entities of a fulfillment network;

in response to detecting said selection, said one or more enterprise computers generating data to be transmitted to said customer, wherein the data includes a plurality of distinct fulfillment options for said inventory items, wherein a given one of said distinct fulfillment options includes an indication that said inventory items will be fulfilled from multiple ones of said fulfillment entities and an indication of a given price corresponding to said given fulfillment option, and wherein a different one of said distinct fulfillment options includes an indication that said inventory items will be fulfilled from a single one of said fulfillment entities and an indication of a different price corresponding to said different fulfillment option, wherein said given price and said different price are different from one another and determined dependent upon fulfillment costs of completing order fulfillment of said inventory items for said customer according to said distinct fulfillment options;

said one or more enterprise computers transmitting the data to said customer, wherein said transmitting includes causing indications of said distinct fulfillment options to be displayed to said customer;

said one or more enterprise computers detecting placement by said customer of an order specifying said inventory items and a particular one of said plurality of distinct fulfillment options; and said one or more enterprise computers conveying fulfillment instructions to one or more of said fulfillment entities dependent on said particular fulfillment option.

2. The method as recited in claim 1, wherein each of said plurality of fulfillment entities within said fulfillment network corresponds to a respective fulfillment center, wherein said enterprise acts as merchant of record for ones of said inventory items fulfilled from said fulfillment centers.

3. The method as recited in claim 1, wherein said fulfillment network also includes one or more third-party merchants that are distinct from said enterprise, and wherein each of said one or more third-party merchants acts as a respective merchant of record for ones of said inventory items fulfilled from said one or more third-party merchants.

4. The method as recited in claim 1, wherein said fulfillment costs of completing order fulfillment of said inventory items for said customer include one or more of: a cost of storing said inventory items, a cost of packaging said inventory items for fulfillment, or a cost of shipping said inventory items to said customer.

5. The method as recited in claim 1, wherein generating said data further comprises limiting the number of distinct fulfillment options included in said data dependent upon preferences established by said customer.

6. The method as recited in claim 5, wherein said preferences specify a maximum number of distinct fulfillment options to be included in said data.

7. The method as recited in claim 5, wherein said preferences specify that said distinct fulfillment options are to be ordered within said data according to said corresponding fulfillment costs.

8. The method as recited in claim 5, wherein each of said distinct fulfillment options includes an indication of one or more corresponding lead times for fulfilling said inventory items, and wherein said preferences specify that said distinct fulfillment options are to be ordered within said data according to said corresponding lead times.

9. The method as recited in claim 1, wherein generating said data to be transmitted to said customer comprises generating a web page including said data, wherein the web page is suitable to be displayed by a web browser associated with said customer.

10. The method as recited in claim 1, wherein detecting said selection of said inventory items by said customer comprises detecting one or more requests by said customer to place said inventory items in a virtual shopping cart.

11. The method as recited in claim 1, wherein detecting said selection of said inventory items by said customer comprises detecting one or more requests by said customer to display information associated with said inventory items.

12. The method as recited in claim 1, further comprising:

dependent upon said customer's choice of said distinct fulfillment options, said one or more enterprise computers instructing that allocation of said inventory items among said fulfillment entities be changed.

13. The method as recited in claim 1, further comprising:

dependent upon detecting that said customer specified said given fulfillment option under which said inventory items will be fulfilled from multiple ones of said fulfillment entities, said one or more enterprise computers instructing that one or more units of each of said inventory items be stocked together within a same one of said fulfillment entities.

14. A non-transitory, computer-accessible storage medium comprising instructions tangibly stored therein, wherein the instructions are executable by a processor to implement:

detecting, at an enterprise, a selection by a customer of a plurality of inventory items, wherein said enterprise includes a plurality of fulfillment entities of a fulfillment network;

in response to detecting said selection, generating a display and instructing that the display be displayed to said customer, wherein the display includes a plurality of distinct fulfillment options for said inventory items, wherein a given one of said fulfillment options includes an indication that said inventory items will be fulfilled from multiple ones of said fulfillment entities and an indication of a given price corresponding to said given fulfillment option, and wherein a different one of said fulfillment options includes an indication that said inventory items will be fulfilled from a single one of said fulfillment entities and an indication of a different price corresponding to said different fulfillment option, wherein said given price and said different price are different from one another and determined dependent upon fulfillment costs of completing order fulfillment of said inventory items for said customer according to said distinct fulfillment options;

transmitting the data to said customer, wherein said transmitting includes causing indications of said distinct fulfillment options to be displayed to said customer;

detecting placement by said customer of an order specifying said inventory items and a particular one of said plurality of distinct fulfillment options; and conveying fulfillment instructions to one or more of said fulfillment entities dependent on said particular fulfillment option.

15. The storage medium as recited in claim 14, wherein each of said plurality of fulfillment entities within said fulfillment network corresponds to a respective fulfillment center, wherein said enterprise acts as merchant of record for ones of said inventory items fulfilled from said fulfillment centers.

16. The storage medium as recited in claim 14, wherein said fulfillment network also includes one or more third-party merchants that are distinct from said enterprise, and wherein each of said one or more third-party merchants acts as a respective merchant of record for ones of said inventory items fulfilled from said one or more third-party merchants.

17. The storage medium as recited in claim 14, wherein said fulfillment costs of completing order fulfillment of said inventory items for said customer include one or more of: a cost of storing said inventory items, a cost of packaging said inventory items for fulfillment, or a cost of shipping said inventory items to said customer.

18. The storage medium as recited in claim 14, wherein to implement generating said display, the instructions are further executable to implement limiting the number of distinct fulfillment options included in said display dependent upon display preferences established by said customer.

19. The storage medium as recited in claim 18 wherein said display preferences specify a maximum number of distinct fulfillment options to be included in said display.

20. The storage medium as recited in claim 18, wherein said display preferences specify that said distinct fulfillment options are to be ordered within said display according to said corresponding fulfillment costs.

21. The storage medium as recited in claim 18, wherein each of said distinct fulfillment options includes an indication of one or more corresponding lead times for fulfilling said inventory items, and wherein said display preferences specify that said distinct fulfillment options are to be ordered within said display according to said corresponding lead times.

22. The storage medium as recited in claim 14, wherein to implement instructing that said display be displayed to said customer, the instructions are further executable to implement conveying a web page including said display to a web browser associated with said customer.

23. The storage medium as recited in claim 14, wherein to implement detecting said selection of said inventory items by said customer, the instructions are further executable to implement detecting a request by said customer to place said inventory items in a virtual shopping cart.

24. The storage medium as recited in claim 14, wherein to implement detecting said selection of said inventory items by said customer, the instructions are further executable to implement detecting a request by said customer to display information associated with said inventory items.

25. A system, comprising:

a memory that stores instructions; and one or more processors coupled to the memory and configured to execute the instructions, wherein the instructions are executable to implement an order management system of an enterprise that presents inventory items to customers in commerce, wherein the inventory items are stored within a fulfillment network comprising a plurality of fulfillment entities, wherein each of said plurality of fulfillment entities is controlled by the enterprise and configured to store and provide order fulfillment services for ones of the plurality of inventory items;

wherein said order management system is configured to:

detect a selection by a given one of said customers of a selected plurality of said inventory items;

in response to detecting said selection, generate a display including a plurality of fulfillment options for said selected inventory items, wherein a given one of said fulfillment options includes an indication that said selected inventory items will be fulfilled from multiple ones of said fulfillment entities and an indication of a given price corresponding to said given fulfillment option, and wherein a different one of said fulfillment options includes an indication that said selected inventory items will be fulfilled from a single one of said fulfillment entities and an indication of a different price corresponding to said different fulfillment option, wherein said given price and said different price are different from one another and determined dependent upon fulfillment costs of completing order fulfillment of said selected inventory items for said given customer according to said fulfillment options;

convey said display to said given customer, wherein to convey the display, the order management system is further configured to cause information indications of said fulfillment options to be displayed to said given customer;

detect placement by said given customer of an order specifying said selected inventory items and a particular one of said fulfillment options; and convey fulfillment instructions for said selected inventory items to one or more of said fulfillment entities dependent on said particular fulfillment option.

26. The system as recited in claim 25, wherein each of said plurality of fulfillment entities within said fulfillment network corresponds to a respective fulfillment center, wherein said enterprise acts as merchant of record for ones of said inventory items fulfilled from said fulfillment centers.

27. The system as recited in claim 25, wherein said fulfillment network also includes one or more third-party merchants that are distinct from said enterprise, and wherein each of said one or more third-party merchants acts as a respective merchant of record for ones of said inventory items fulfilled from said one or more third-party merchants.

28. The system as recited in claim 25, wherein said fulfillment costs of completing order fulfillment of said selected inventory items for said given customer include one or more of: a cost of storing said selected inventory items, a cost of packaging said selected inventory items for fulfillment, or a cost of shipping said selected inventory items to said given customer.

29. The system as recited in claim 25, wherein to generate said display, said order management system is further configured to limit the number of fulfillment options included in said display dependent upon display preferences established by said given customer.

30. The system as recited in claim 29 wherein said display preferences specify a maximum number of fulfillment options to be included in said display.

31. The system as recited in claim 29 wherein said display preferences specify that said fulfillment options are to be ordered within said display according to said corresponding fulfillment costs.

32. The system as recited in claim 29 wherein each of said fulfillment options includes an indication of one or more corresponding lead times for fulfilling said selected inventory items, and wherein said display preferences specify that said fulfillment options are to be ordered within said display according to said corresponding lead times.

33. The system as recited in claim 25, wherein to convey said display to said given customer, said order management system is further configured to convey a web page including said display to a web browser associated with said given customer.

34. The system as recited in claim 25, wherein to detect said selection said selected inventory items by said given customer, said order management system is further configured to detect a request by said given customer to place said selected inventory items in a virtual shopping cart.

35. The system as recited in claim 25, wherein to detect said selection said selected inventory items by said given customer, said order management system is further configured to detect a request by said given customer to display information associated with said selected inventory items.

* * * * *